United States Patent [19]

Kojima et al.

[11] Patent Number: 5,020,499

[45] Date of Patent: Jun. 4, 1991

[54] APPARATUS FOR DETECTING ABNORMALITY OF OXYGEN SENSOR AND CONTROLLING AIR/FUEL RATIO

[75] Inventors: Takao Kojima, Nagoya; Masaru Yamano, Komaki; Toshiki Sawada, Nagoya, all of Japan

[73] Assignee: NGK Spark Plug Co., Ltd., Aichi, Japan

[21] Appl. No.: 539,119

[22] Filed: Jun. 18, 1990

[30] Foreign Application Priority Data

Jun. 16, 1989 [JP] Japan ..... 1-155229
Jun. 16, 1989 [JP] Japan ..... 1-155230

[51] Int. Cl.[5] ..... F02D 41/22
[52] U.S. Cl. ..... 123/479; 204/401
[58] Field of Search ..... 123/440, 479, 489; 73/23.32; 204/401

[56] References Cited

U.S. PATENT DOCUMENTS 4,142,482 3/1979 Asano et al. ..... 123/440
4,638,658 1/1987 Otobe ..... 123/489 X
4,751,908 6/1988 Abe et al. ..... 123/479 X
4,844,038 7/1989 Yamato et al. ..... 123/479
4,887,576 12/1989 Inamoto et al. ..... 123/489 X

FOREIGN PATENT DOCUMENTS 53-95421 8/1978 Japan .
62944 4/1982 Japan ..... 123/479
65948 4/1983 Japan ..... 123/479
58-222939 12/1983 Japan .
59-3137 1/1984 Japan .

*Primary Examiner*—Tony M. Argenbright
*Attorney, Agent, or Firm*—Sughrue, Mion, Zinn, Macpeas & Seas

[57] ABSTRACT

This invention provides apparatus for detecting abnormality of an oxygen sensor accurately and also apparatus for appropriately controlling the air/fuel ratio of air and fuel mixture when an oxygen sensor is abnormal. The apparatus easily and properly detects a deteriorating oxygen sensor, with the use of which exhaust of nitrogen oxides or carbon monoxide increases, and when the oxygen sensor is determined to deteriorate, the feed back control of the air/fuel ratio of air and fuel mixture supplied to an internal combustion engine is preferably performed.

18 Claims, 15 Drawing Sheets

APPARATUS FOR DETECTING ABNORMALITY OF OXYGEN SENSOR AND CONTROLLING AIR/FUEL RATIO

BACKGROUND OF THE INVENTION

The present invention relates to an apparatus for detecting abnormality of an oxygen sensor which measures the oxygen concentration of exhaust gas discharged from an internal combustion engine and also for controlling the air/fuel ratio of air and fuel mixture supplied to the internal combustion engine according to data showing abnormality of the oxygen sensor.

The air/fuel ratio of an air and fuel mixture supplied to an internal combustion engine is generally controlled based on a signal sent from an oxygen sensor provided in the exhaust system of the engine so as to lower the emission of exhaust discharge of the engine. As shown in FIG. 19, the air/fuel ratio is controlled in accordance with the output signal of the oxygen sensor in order to maintain the air/fuel ratio near the stoichiometric ratio at which purification of exhaust components reaches the optimum stage.

When the oxygen sensor used for feed-back controlling the air/fuel ratio is abnormal, the emission of exhaust discharge may increase. Various techniques have hence been proposed for diagnosing abnormality of the oxygen sensor and furthermore for, when abnormality of the oxygen sensor is detected, compensating the feed-back control of the air/fuel ratio. Examples of apparatus for diagnosing abnormality of the oxygen sensor are illustrated in Japanese Published Unexamined Patent Applications No. Sho-62-151770 and No. Sho-53-95421; and apparatus for compensating the air/fuel ratio control are in Japanese Published Unexamined Patent Applications No. Sho-58-222939 and No. Sho-59-3137.

When the oxygen sensor is contaminated by various substances, the sensor output shifts to lean or rich as shown in FIG. 20; that is, the performance of the oxygen sensor varies. The feed-back control of the air/fuel ratio according to an output signal of the oxygen sensor is thereby not performed satisfactorily, and thus the emission of exhaust discharge increases.

For example, when the oxygen sensor contaminated by silicon is used for feed-back control of the air/fuel ratio, nitrogen oxides (NOx) in the exhaust discharge increase; and when the oxygen sensor contaminated by lead is used, carbon monoxide (CO) in the exhaust discharge increases.

SUMMARY OF THE INVENTION

One objective of the invention is to provide apparatus for accurately detecting abnormality of an oxygen sensor.

Another objective of the invention is to provide apparatus for appropriately controlling the air/fuel ratio of air and fuel mixture when an oxygen sensor is abnormal.

One embodiment of the present invention that realizes the first and other related objectives is an abnormality detecting device for oxygen sensors shown in FIG. 1, which detects abnormality of an oxygen sensor M2 sending a signal according to the oxygen concentration of exhaust gas discharged from an internal combustion engine M1. The abnormality detecting device includes air/fuel ratio setting means M3 for setting the air/fuel ratio of air and fuel mixture supplied to the internal combustion engine M1 lean or rich by open loop control; and abnormality detecting means M4 for determining that the oxygen sensor M2 is abnormal if an output signal of the oxygen sensor M2 is not less than a predetermined threshold when the air/fuel ratio is set to be lean by the air/fuel ratio setting means M3. Alternatively, the oxygen sensor is determined to be abnormal if an output signal of the oxygen sensor M2 is not greater than a predetermined threshold when the air/fuel ratio is set to be rich.

In the abnormality detecting device for oxygen sensors shown in FIG. 1, the air/fuel ratio of air and fuel mixture supplied to the internal combustion engine M1 is set to be lean or rich by open loop control by the air/fuel ratio setting means M3. If an output signal of the oxygen sensor M2 is not less than a predetermined threshold when the air/fuel ratio is set lean, the abnormality detecting means M4 determines that the oxygen sensor M2 is abnormal. If, on the other hand, an output signal of the oxygen sensor M2 is not greater than a predetermined threshold when the air/fuel ratio is set rich, the abnormality detecting means M4 also determines that the oxygen sensor M2 is abnormal.

Another embodiment of the invention is an abnormality detecting device for oxygen sensors shown in FIG. 2, which detects an abnormality of an oxygen sensor M6 sending a signal according to the oxygen concentration of exhaust gas discharged from an internal combustion engine M5. The abnormality detecting device includes air/fuel ratio setting means M7 for periodically changing the air/fuel ratio of air and fuel mixture supplied to the internal combustion engine M1 between lean and rich by open loop control; limit value detecting means M8 for detecting the minimum and maximum values of an output signal sent from the oxygen sensor M6 when the air/fuel ratio is set to be rich or lean by the air/fuel ratio setting means M7; and abnormality detecting means M9 for determining that the oxygen sensor M6 is abnormal when at least one of the minimum and maximum values detected by the limit value detecting means M8 is within a predetermined output range.

The minimum and maximum values of an output signal may be the average of plural measurements.

In the abnormality detecting device for oxygen sensors shown in FIG. 2, the air/fuel ratio of air and fuel mixture supplied to the internal combustion engine M5 is periodically changed between lean and rich by open loop control by the air/fuel ratio setting means M7. The minimum and maximum values of an output signal, sent from the oxygen sensor M6 when the air/fuel ratio is set rich or lean, are detected by the limit value detecting means M8. When at least one of the minimum and maximum values is within a predetermined output range, the abnormality detecting means M9 determines that the oxygen sensor M6 is abnormal.

A further embodiment of the invention is an abnormality detecting device for oxygen sensors shown in FIG. 3, which detects abnormality of an oxygen sensor M11 outputting a signal according to the oxygen concentration of exhaust gas discharged from an internal combustion engine M10. The abnormality detecting device includes air/fuel ratio controlling means M12 for feed-back controlling the air/fuel ratio of air and fuel mixture supplied to the internal combustion engine M10 according to an output signal of the oxygen sensor M11; and abnormality detecting means M13 for determining that the oxygen sensor M11 is abnormal if an output signal of the oxygen sensor M11 is within a predetermined range when the feed-back control of the air/fuel ratio is executed by the air/fuel ratio controlling means M12.

In the abnormality detecting device for oxygen sensors shown in FIG. 3, the feed-back control of the air/fuel ratio is performed based on an output signal sent from the oxygen sensor M11 by the air/fuel ratio controlling means M12. If the output signal of the oxygen sensor M11 is within a predetermined range when the feed-back control of the air/fuel ratio is executed, the abnormality detecting means M13 determines that the oxygen sensor M11 is abnormal.

An embodiment of the present invention for realizing the first, second, and other related objectives is an air/fuel ratio controlling device shown in FIG. 4, which controls the air/fuel ratio of air and fuel mixture supplied to an internal combustion engine M14 according to an output signal sent from an oxygen sensor M15 provided in the exhaust system of the internal combustion engine M14. The air/fuel ratio controlling device includes abnormality detecting means M16 for determining that the oxygen sensor M15 is abnormal according to the variation of an output signal of the oxygen sensor M15; air/fuel ratio setting means M17 for setting the air/fuel ratio of air and fuel mixture supplied to the internal combustion engine M14 lean and rich by open loop control; median computing mean M18 for determining the median of lean and rich signals outputted from the oxygen sensor M15 when the air/fuel ratio is set to be lean and rich by the air/fuel ratio setting means M17; and threshold setting means M19 for setting the median determined by the median computing means M18 as a threshold which discriminates between rich and lean states of the air/fuel ratio in feed-back control when abnormality of the oxygen sensor M15 is detected by the abnormality detecting means M16.

In the air/fuel ratio controlling device of the invention shown in FIG. 4, the air/fuel ratio of air and fuel mixture supplied to the internal combustion engine M14 is controlled according to an output signal sent from the oxygen sensor M15 provided in the exhaust system of the internal combustion engine M14. When the abnormality detecting means M16 determines that the oxygen sensor M15 is abnormal, the air/fuel ratio of the mixture supplied to the internal combustion engine M14 is set lean or rich by open loop control by the air/fuel ratio setting means M17. Then the median of lean or rich signal sent from the oxygen sensor M15 is computed by the median computing mean M18. The threshold setting means M19 sets the median as a threshold which discriminates between rich and lean states of the air/fuel ratio in feed-back control.

Here the abnormality detecting means M16 may be operated by variety of principles; for example, the means M16 may be substantially identical to any of the abnormality detecting means M4, M9 and M13.

The open loop control is not feed-back control in which the air/fuel ratio of air and fuel mixture is controlled according to an output signal sent from an oxygen sensor, but is simple selection control in which the air/fuel ratio is simply set to a rich or lean state.

The principles of the abnormality detecting devices for oxygen sensors are described now.

(1) Abnormality detecting device for oxygen sensors shown in FIG. 1.

As shown in FIG. 5, in a normal oxygen sensor, when the air/fuel ratio is shifted from lean (e.g., ratio of air excess $\lambda=1.03$) to rich ($\lambda=0.97$) by open loop control, the output signal of the oxygen sensor changes from lower than a first threshold $V_1$ (e.g., 300 mV) and to higher than a second threshold $V_2$ (e.g., 700 mV); namely an output signal of the oxygen sensor oscillates with a large variation in.

When the feed-back control of the air/fuel ratio is executed based on an output signal of an oxygen sensor contaminated by silicon, exhaust of nitrogen oxides (NOx) increases. In the oxygen sensor contaminated by silicon, the output signal (voltage) is higher than those of the normal oxygen sensor when the air/fuel ratio is in lean state. On the other hand, when the feed-back control of the air/fuel ratio is executed based on an output signal of an oxygen sensor contaminated by lead, exhaust of carbon monoxide (CO) increases. In the oxygen sensor contaminated by lead, the output signal (voltage) is lower than those of the normal oxygen sensor when the air/fuel ratio is in rich state.

When the output signal of the oxygen sensor becomes not less than the first threshold $V_1$ in the lean air/fuel ratio, the oxygen sensor is determined to deteriorate so as to cause the internal combustion engine to discharge a large amount of NOx. On the other hand, when the an output signal of the oxygen sensor become not greater than the second threshold $V_2$ in the rich air/fuel ratio, the oxygen sensor is determined to deteriorate so as to cause the internal combustion engine to discharge a large amount of CO.

(2) Abnormality detecting device for oxygen sensors shown in FIG. 2.

As shown in FIG. 6, in a normal oxygen sensor, when the air/fuel ratio is periodically changed between lean and rich states by open loop control, the output signal oscillates with a large variation in; the minimum of the output signal becomes lower than a first threshold $V_1$ and the maximum becomes higher than a second threshold $V_2$.

In an oxygen sensor contaminated such that exhaust of NOx increases, the output signal has a high voltage and oscillates around the second threshold $V_2$ with a small amplitude. In an oxygen sensor contaminated such that exhaust of CO increases, the output signal has a low voltage and oscillate around the first threshold $V_1$ with a small amplitude.

When either the minimum or the maximum of the output signal sent from the oxygen sensor is within a predetermined range between the first threshold $V_1$ and the second threshold $V_2$, the oxygen sensor is determined to be abnormal.

(3) Abnormality detecting device for oxygen sensors shown in FIG. 3.

As shown in FIG. 7, in a normal oxygen sensor, when the feed-back control of the air/fuel ratio is executed, the output signal sent from the oxygen sensor oscillates with a large variation in.

In an oxygen sensor deteriorated such that exhaust of either NOx or CO increases, when the feed-back control of the air/fuel ratio is executed, the output signal oscillates with a small amplitude near a slice level $V_0$ located between threshold $V_L$ and threshold $V_O$.

When the output signal of the oxygen sensor is within a predetermined range around the slice level $V_0$, the oxygen sensor is determined to be abnormal.

BRIEF DESCRIPTION OF THE DRAWINGS

The invention may be best understood by referring to the following detailed description of preferred embodiments and the accompanying drawings, wherein like numerals denote like elements and in which.

DETAILED DESCRIPTION OF PREFERRED EMBODIMENTS

Figure 1:
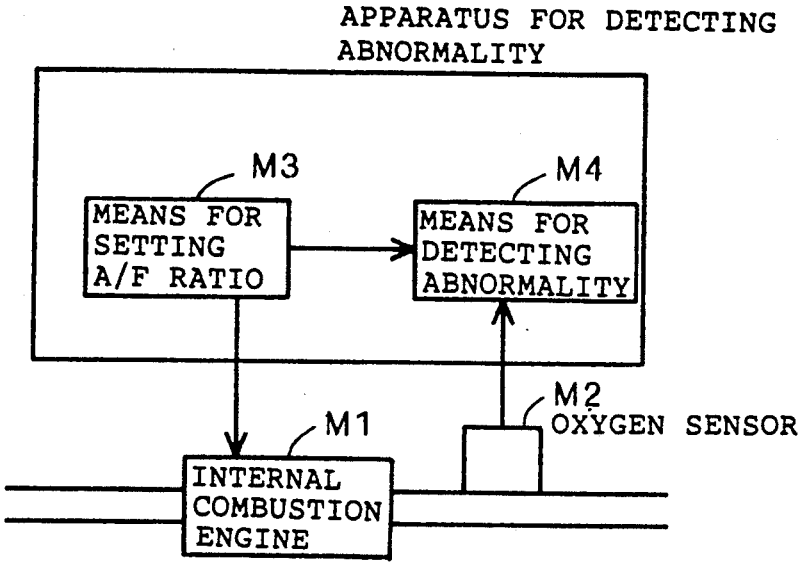
FIG. 1 is a block diagram showing a feature of an abnormality detecting device for oxygen sensors according to the invention.

Preferred embodiments of the invention are now described referring to the drawings. Since there may be many modifications without departing from the scope of the invention, the embodiments below are not intended to limit the invention to the embodiments, but are intended to illustrate the invention more clearly.

Figure 8:
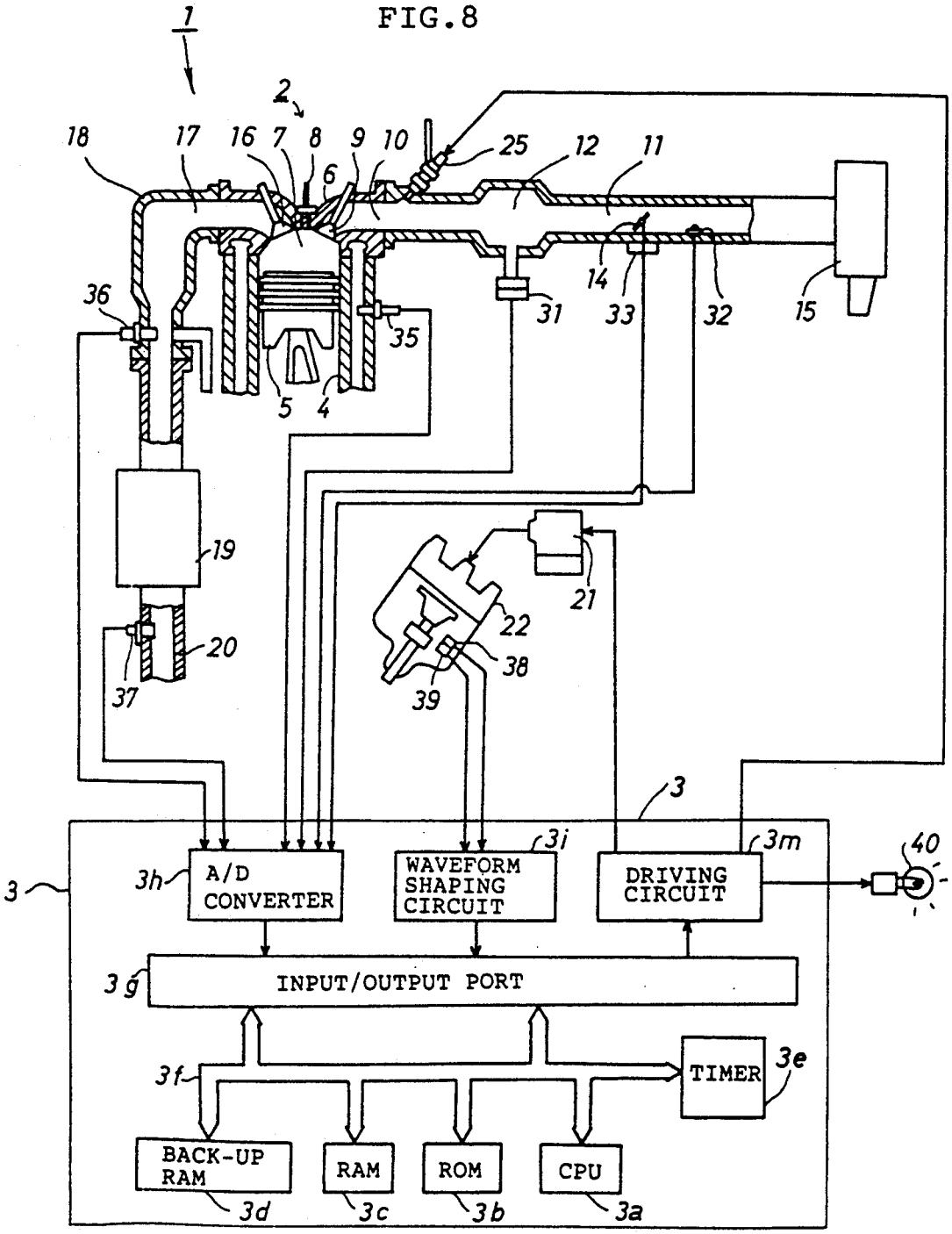
FIG. 8 is a schematic view illustrating the invention.

FIG. 8 is a schematic view illustrating the invention; i.e., an apparatus for detecting abnormality of an oxygen sensor and for feed-back controlling the air/fuel ratio.

The apparatus 1 includes an electronic control unit (hereinafter referred to as ECU) 3 for detecting the conditions of an engine 2 and executing various operations, e.g., controlling the air/fuel ratio and diagnosing abnormality of the oxygen sensor.

The engine 2 has a combustion chamber 7 including a cylinder 4, a piston 5, and cylinder head 6. The combustion chamber further includes an ignition plug 8.

The inlet system of the engine 2 includes an intake valve 9, an inlet port 10, an inlet pipe 11, a surge tank 12 for absorbing surges of intake air, a throttle valve 14 for controlling the amount of intake air, and an air cleaner 15.

The exhaust system of the engine 2 includes an exhaust valve 16, an exhaust port 17, an exhaust manifold 18, a catalytic converter 19 filled with a three-way catalyst, and an exhaust pipe 20.

The ignition system of the engine 2 includes an igniter 21 for generating a high voltage sufficient for ignition and a distributor 22 connected to a crank shaft (not shown) for selectively distributing the high voltage generated by the igniter 21 to the ignition plug 8.

The fuel system of the engine 2 includes an electromagnetic fuel injection valve 25 for injecting fuel sent from a fuel tank (not shown) into the inlet port 10.

The engine 2 further has sensors for detecting the driving conditions; i.e., a manifold air pressure sensor 31 for detecting the pressure of intake air, an intake air temperature sensor 32 for detecting the temperature of intake air, a throttle position sensor 33 for detecting the opening of the throttle valve 14, a water temperature sensor 35 for detecting the temperature of cooling water, and an upstream oxygen sensor 36 (hereinafter referred to as an oxygen sensor) for detecting the oxygen concentration of exhaust gas before it flows into the catalytic converter 19. A downstream oxygen sensor 37 (hereinafter referred to as a sub-oxygen sensor) may be provided if necessary for detecting the oxygen concentration of exhaust gas after it flows out of the catalytic converter 19. A cylinder discrimination sensor 38 for outputting a standard signal at every rotation of a cam shaft of the distributor 22 and an engine speed sensor 39 for outputting a signal of rotation angle at every 1/24 rotation of the cam shaft of the distributor 22 are provided.

An output signal from the sensors is sent to the ECU 3. According to the input signal, the engine speed control, the air/fuel ratio control, and other controls are executed. The ECU 3 forms a logical operation circuit including a central processing unit (CPU) 3*a*, a read only memory (ROM) 3*b*, a random access memory (RAM) 3*c*, a backup RAM 3*d*, and a timer 3*e*; the components in the CPU are connected to an input/output port 3*g* through a common bus 3*f* and further connected to peripheral devices. The CPU 3*a* receives detection signals sent through an A/D converter 3*h* and the input/output port 3*g* from the manifold air pressure sensor 31, the intake air temperature sensor 32, the throttle position sensor 33, the water temperature sensor 35, the oxygen sensor 36, and the sub-oxygen sensor 37. The CPU also receives signals sent from the cylinder discrimination sensor 38 and the engine speed sensor 39 through a waveform shaping circuit 3*i* and the input/output port 3*g*. The CPU 3*a* drives and controls the igniter 21, the fuel ejection valve 25, and a check lamp 40 for informing an operator of an abnormality of the oxygen sensor 36.

Electricity is supplied to the backup RAM 3*d* of the ECU 3 without running through an ignition switch (not shown); thus various data, such as thresholds for feedback control, are thus maintained irrespective of the conditions of the ignition switch.

Processes of first through fourth embodiments for detecting abnormality of the oxygen sensor 36 executed by the ECU 3 are now explained based on the corresponding flow charts. Devices of the first through fourth embodiments have a substantially similar construction to that shown in the schematic view of FIG. 8.

Figure 9:
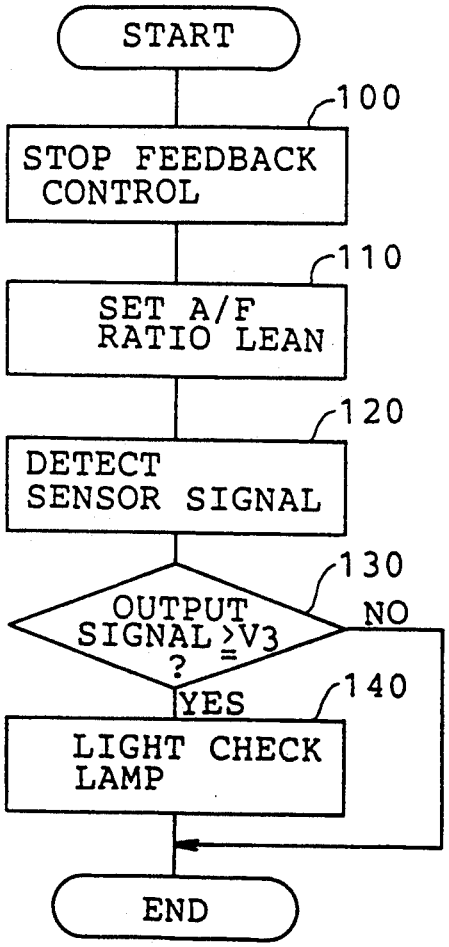
FIG. 9 is a flow chart showing process of a first embodiment according to the feature shown in FIG. 1.

The first embodiment will now be discussed with reference to FIG. 1. Processing for determining if the oxygen sensor 36 is contaminated by silicon and thus deteriorated such that the use of the sensor 36 increases nitrogen oxides (NOx) of exhaust discharge in feed-back control is explained based on the flow chart of FIG. 9. This processing starts after warm-up of the engine 2.

At step 100, the feed-back control of the air/fuel ratio stops and open loop control starts. At step 110, the air/fuel ratio is set to lean in the open loop control by driving and regulating the fuel ejection valve 25. The opening time period of the fuel ejection valve 25 is shortened, and the air/fuel ratio is set to lean, for example, at air excess rate $\lambda=1.03$, and is maintained for a certain time period. The output signal sent from the oxygen sensor 36 is detected at step 120. When the output signal of the oxygen sensor 36 is not less than a predetermined threshold $V_3$ (e.g., 300 mV), at step 130 the oxygen sensor is determined to be contaminated by silicon. The exhaust of nitrogen oxides will therefore be excessive. The check lamp 40 is then lit at step 140 and program exits from the processing.

This process enables deteriorating oxygen sensors that are contaminated such that exhaust of NOx is excessive to be easily discriminated.

Figure 10:
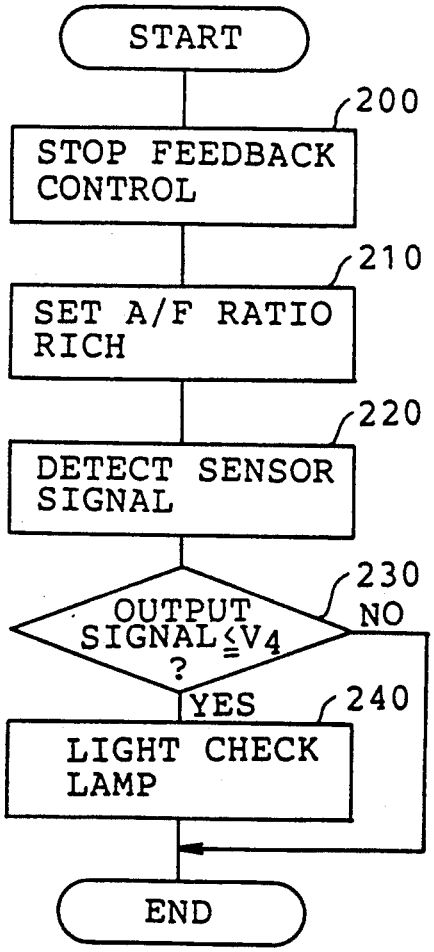
FIG. 10 is a flow chart showing process of a second embodiment according to the feature shown in FIG. 1.

The second embodiment will also be discussed with reference to FIG. 1. Processing for determining if the oxygen sensor 36 is contaminated by lead and thus deteriorated such that the use of the sensor 36 increases carbon monoxide (CO) of exhaust discharge in feed-back control is explained based on the flow chart of FIG. 10.

At step 200, the feed-back control of the air/fuel ratio stops and open loop control starts. At step 210, the air/fuel ratio is set to rich in the open loop control by driving and regulating the fuel ejection valve 25. The opening time period of the fuel ejection valve 25 is increased, and the air/fuel ratio is set rich, for example to $\lambda=0.97$, and is maintained for a certain time period. The output signal sent from the oxygen sensor 36 is detected at step 220. When the output signal of the oxygen sensor 36 is not greater than a predetermined threshold $V_4$ (e.g., 700 mV), at step 230 the oxygen sensor is determined to be contaminated by lead. The exhaust of carbon monoxide will therefore be excessive. The check lamp 40 is then lit at step 240 and program exits from the processing.

This process enables deteriorating oxygen sensors that are contaminated such that exhaust of CO is excessive to be easily discriminated.

Figure 11:
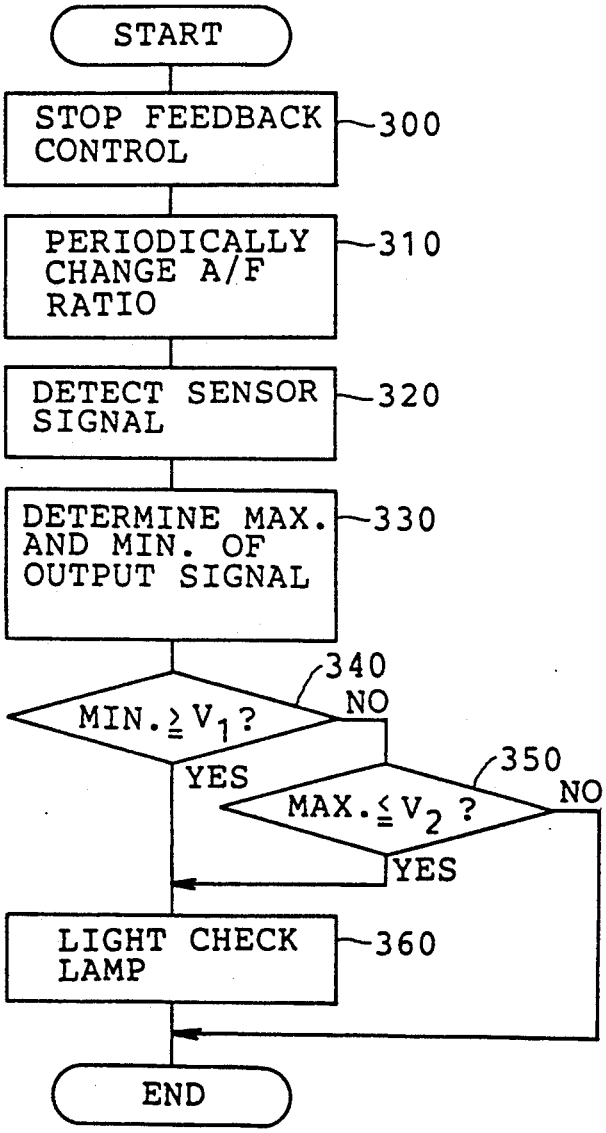
FIG. 11 is a flow chart showing process of a third embodiment according to the feature shown in FIG. 2.

The third embodiment will be described with reference to FIG. 2. Processing for determining if the oxygen sensor 36 is contaminated by silicon or lead and thereby deteriorated is explained based on the flow chart of FIG. 11.

Figure 6:
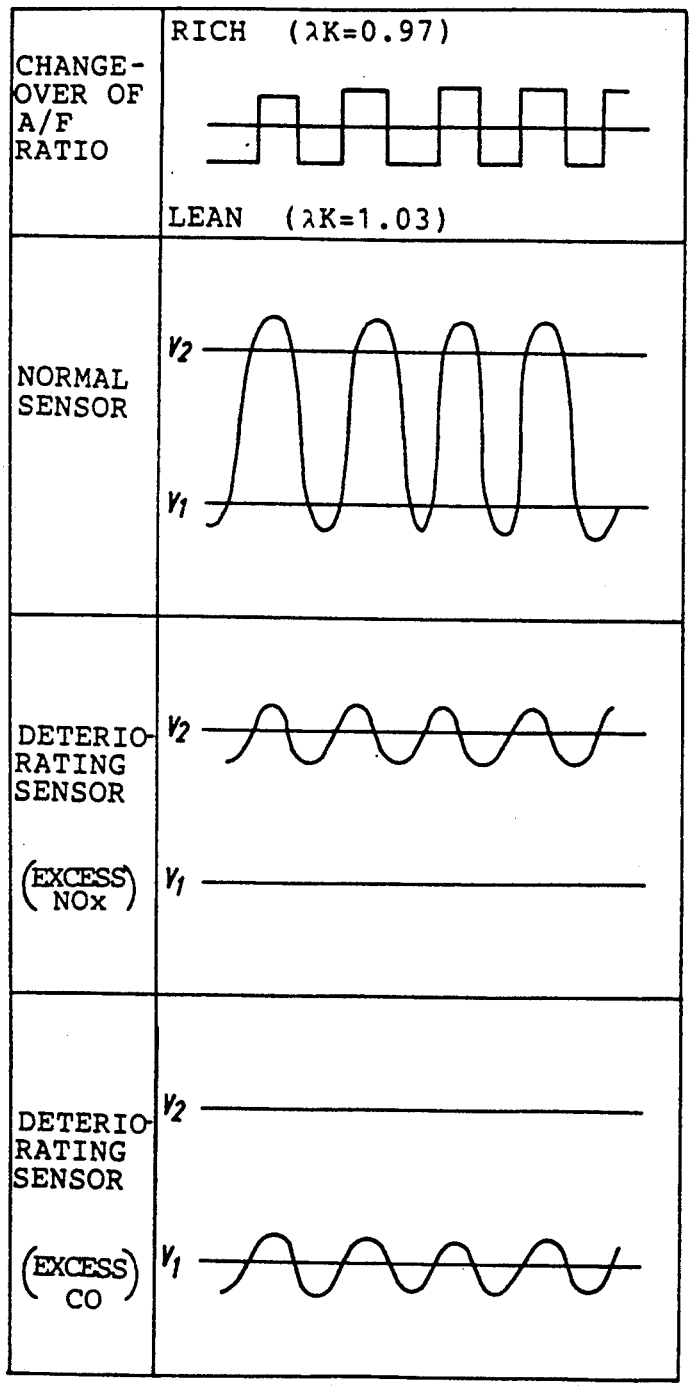
FIG. 6 is an illustrative view showing the principles of the feature of the invention shown in FIG. 2.

At step 300, the feed-back control of the air/fuel ratio stops and open loop control starts. At step 310, the air/fuel ratio is periodically changed between lean and rich in the open loop control by driving and regulating the fuel ejection valve 25. The opening time period of the fuel ejection valve 25 is adjusted, and the air/fuel ratio is periodically changed between rich, e.g., $\lambda=0.97$ and lean, e.g., $\lambda=1.03$ at the cycle of 2 Hz. The output signal sent from the oxygen sensor 36 is detected at step 320. The program proceeds to step 330 at which the minimum and maximum of the output signal are determined. Then, at step 340 and step 350, it is determined if the minimum and the maximum of the output signal of the oxygen sensor 36 are within a predetermined output range. When either the minimum or the maximum of the output signal is determined to be within the predetermined range, that is, when the minimum is not less than a first threshold $V_1$ (step 340) or when the maximum is not greater than a second threshold $V_2$ (step 350) as shown in FIG. 6, the oxygen sensor 36 is determined to be contaminated and thus its operation is degraded. The check lamp 40 is then lit at step 360 and the program exits from the processing.

This process enables an oxygen sensor whose operation is degraded by contamination to be easily discriminated.

Figure 3:
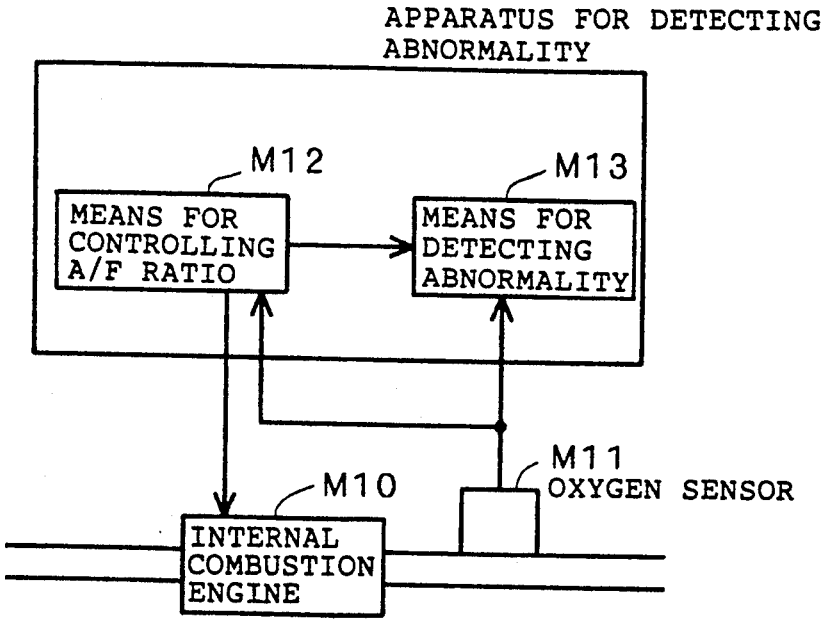
FIG. 3 is a block diagram showing a further feature of an abnormality detecting device for oxygen sensors according to the invention.
Figure 12:
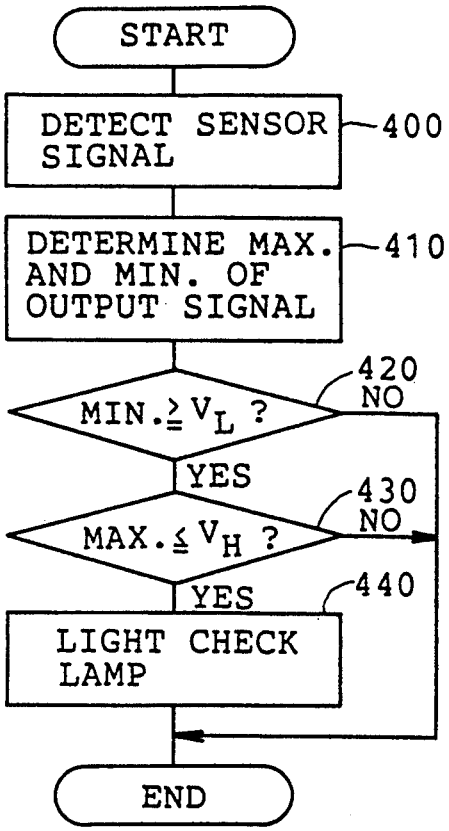
FIG. 12 is a flow chart showing process of a fourth embodiment according to the feature shown in FIG. 3.

The fourth embodiment is in accordance with the feature of FIG. 3. Processing for determining if the oxygen sensor 36 is contaminated by silicon or lead and thereby deteriorated is explained based on the flow chart of FIG. 12. This process for detecting abnormality of the oxygen sensor 36 is executed while the feed-back control of the air/fuel ratio is being executed.

Figure 7:
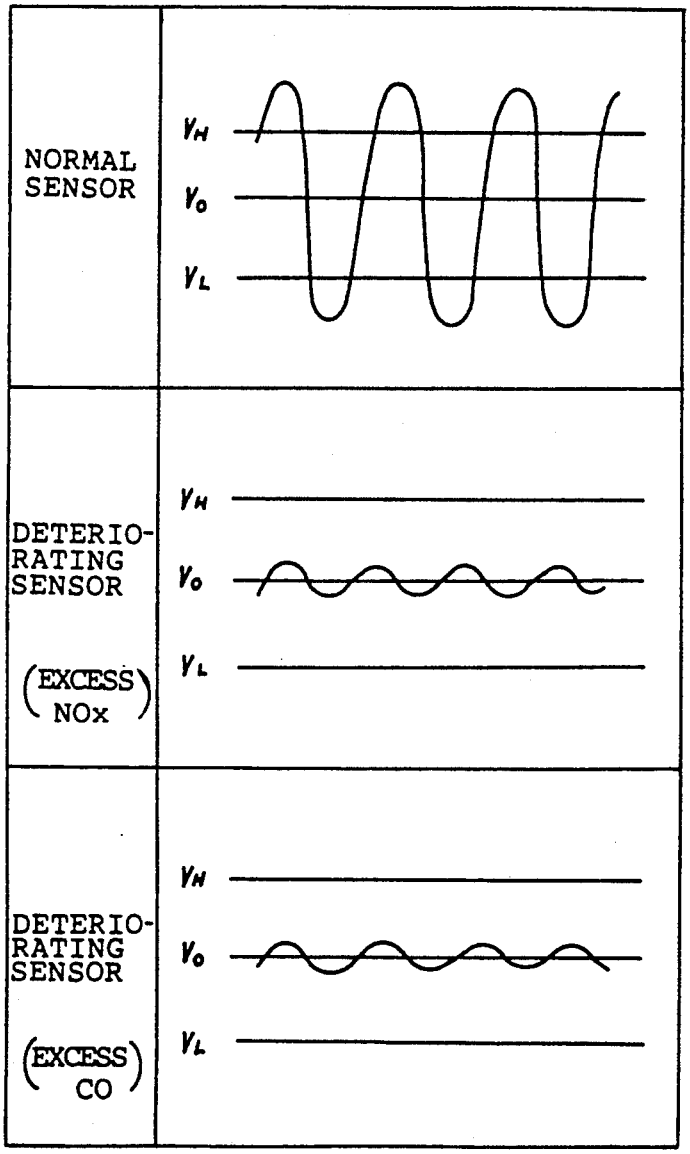
FIG. 7 is an illustrative view showing the principles of the feature of the invention shown in FIG. 3.

At step 400, an output signal sent from the oxygen sensor 36 are detected while the feed-back control of the air/fuel ratio is being executed. The program proceeds to step 410 at which the minimum and maximum of the output signal are determined. Then at step 420 and step 430, it is determined if the minimum and the maximum of the output signal are within a predetermined range around a slice level $V_0$ between threshold $V_1$ and threshold $V_0$. When the minimum is not less than a threshold $V_L$ lower than the slice level $V_0$ at step 420 and when the maximum is not greater than a threshold $V_H$ higher than the slice level $V_0$ at step 430 as shown in FIG. 7, the oxygen sensor 36 is determined to be contaminated and its operation thus degraded. The check lamp 40 is then lit at step 440 and program exits from the processing.

The above processes for detecting abnormality of the oxygen sensor 36 may be executed when a car with the oxygen sensor 36 stops at a traffic light or is checked and examined in a garage. In the above first through fourth embodiments, deterioration of the oxygen sensor 36 is detected, but the same processes are applicable to detecting deterioration of the sub-oxygen sensor 37.

As described above, in the apparatus for detecting abnormality of an oxygen sensor shown in FIG. 1, the oxygen sensor is determined to be abnormal and its operation degraded if an output signal of the oxygen sensor is not less than a predetermined threshold when the air/fuel ratio is set to lean, or if an output signal of the oxygen sensor is not greater than a predetermined threshold when the air/fuel ratio is set to rich. Deteriorating oxygen sensors which are contaminated by silicon or lead and therefore resulting in an increased exhaust of NOx or CO in the feed-back control of the air/fuel ratio are easily and accurately detected.

Figure 2:
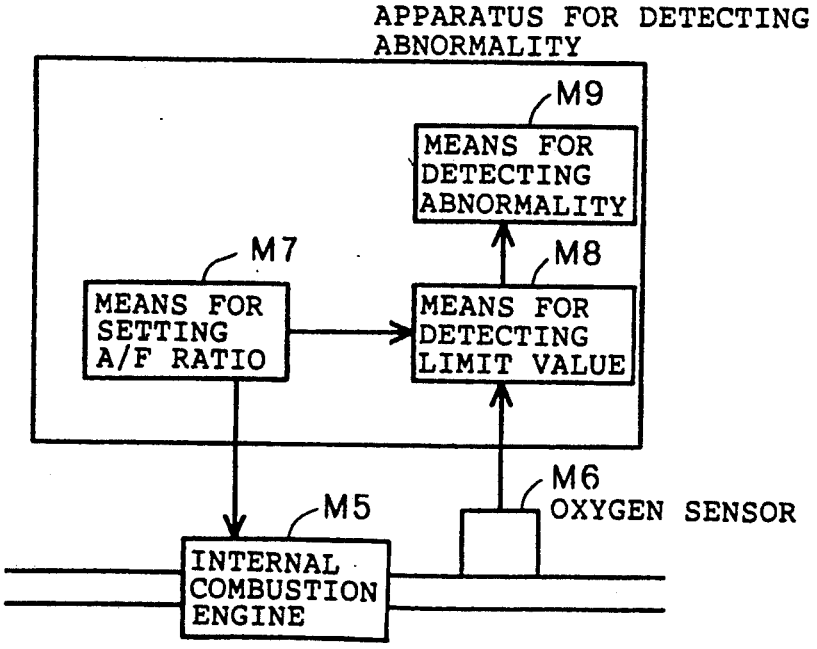
FIG. 2 is a block diagram showing another feature of an abnormality detecting device for oxygen sensors according to the invention.

In the apparatus for detecting abnormality of an oxygen sensor shown in FIG. 2, the minimum and maximum of a signal, output from the oxygen sensor when the air/fuel ratio is set to lean or rich by open loop control are determined. The oxygen sensor is determined to be abnormal and its operation degraded when at least one of the minimum and maximum values is within a predetermined output range. Deteriorating oxygen sensors are also easily and accurately detected.

In the apparatus for detecting abnormality of an oxygen sensor shown in FIG. 3, the feed-back control of the air/fuel ratio is performed based on an output signal sent from the oxygen sensor. When the output signal of the oxygen sensor is within a predetermined output range, the oxygen sensor is determined to be abnormal and thus its operation degraded. Deteriorating oxygen sensors are as easily and accurately detected by the above apparatus.

Now examples in which abnormality of the oxygen sensor 36 is detected by the above processes are explained.

In the examples below, the normal oxygen sensor or deteriorating oxygen sensor 36 is mounted on the exhaust system of a vehicle. An output signal of the oxygen sensor 36 are detected under various conditions, e.g., the variation of the engine speed or the air/fuel ratio.

(EXAMPLE 1)

Voltages of the signals output from plural oxygen sensors in the lean air/fuel ratio are measured at variety of engine speeds. The exhaust amount of nitrogen oxides varies depending on the oxygen sensor. Table 1 shows the measurement conditions and the results. In Table 1, A and B denote automobile models on which the oxygen sensors are mounted, and C and D denote measurement conditions. The conditions of C are as follows: a large flow rate of exhaust discharge; engine speed 1,500 rpm; and the air excess rate $\lambda=1.04$. The conditions of D are as follows: a small flow rate of exhaust discharge; engine speed 800 rpm; and the air excess rate $\lambda=1.03$. Samples No. 1 and No. 2 are normal oxygen sensors and No. 3 through No. 5 are deteriorating sensors which increase the exhaust of nitrogen oxides. Each resulting value in Table 1 is the average of three measurements.

TABLE 1

| Emission of NOx in exhaust gas (g/mile) | | | Sensor output voltage (mV) | |
|---|---|---|---|---|
| | | | C | D |
| | Automobile models | | 1,500 rpm | 800 rpm |
| No. | A | B | $\lambda = 1.04$ | $\lambda = 1.03$ |
| 1 | 0.20 | 0.40 | 80 | 75 |
| 2 | 0.52 | 1.20 | 280 | 200 |
| 3 | 0.70 | 1.60 | 450 | 380 |
| 4 | 1.20 | 3.50 | 550 | 450 |
| 5 | 1.71 | 5.10 | 700 | 650 |

As clearly seen in Table 1, in the normal oxygen sensors, No. 1 and No. 2, the sensor outputs in the lean air/fuel ratio range are maintained small irrespective of the engine speed. In the deterioration oxygen sensors, No. 3 through No. 5, on the other hand, the sensor outputs are relatively large. With a predetermined threshold (e.g., 300 mV), oxygen sensors are thus easily determined to be normal ones or deteriorating ones, in other words, those increase exhaust of NOx.

Table 2 shows the preferable measurement conditions.

TABLE 2

| | Condition 1 | Condition 2 | Condition 3 |
|---|---|---|---|
| Engine speed rpm | 500 to 1,000 | 1,000 to 1,500 | 1,500 to 2,000 |
| Air excess rate ($\lambda$) | 1.0 to 1.03 | 1.01 to 1.04 | 1.02 to 1.05 |

(EXAMPLE 2)

Voltages of the signals output from plural oxygen sensors in the rich air/fuel ratio are measured at variety of engine speeds. The exhaust amount of carbon monoxide varies depending on the oxygen sensor. Table 3 shows the measurement conditions and the results. In Table 3, A and B are the same as Example 1, and C and D are also the same except the air excess rate $\lambda=0.97$. Samples No. 1 and No. 2 are normal oxygen sensors and No. 3 and No. 4 are deteriorating sensors which increase carbon monoxide. Each resulting value in Table 1 is the average of three measurements.

TABLE 3

| Emission of CO in exhaust gas (g/mile) | | | Sensor output voltage (mV) | |
|---|---|---|---|---|
| | | | C | D |
| | Automobile models | | 1,500 rpm | 800 rpm |
| No. | A | B | $\lambda = 0.97$ | $\lambda = 0.97$ |
| 1 | 5.0 | 2.5 | 890 | 900 |
| 2 | 7.2 | 4.1 | 800 | 820 |
| 3 | 9.8 | 6.2 | 580 | 600 |
| 4 | 11.8 | 8.9 | 360 | 390 |

As clearly seen in Table 3, in the normal oxygen sensors, No. 1 and No. 2, the sensor outputs in the rich air/fuel ratio are maintained large irrespective of the engine speed. In the deterioration oxygen sensors, No. 3 and No. 4, on the other hand, the sensor outputs are relatively small. With a predetermined threshold (e.g., 700 mV), oxygen sensors are thus easily determined to be normal ones or deteriorating ones that allows an increase in exhaust of CO.

Table 4 shows the preferable measurement conditions.

TABLE 4

| | Condition 1 | Condition 2 | Condition 3 |
|---|---|---|---|
| Engine speed (rpm) | 500 to 1,000 | 1,000 to 1,500 | 1,500 to 2,000 |
| Air excess rate ($\lambda$) | 0.99 to 0.97 | 0.99 to 0.96 | 0.99 to 0.96 |

(EXAMPLE 3)

In Example. 3, the air/fuel ratio is periodically changed between lean and rich. The minimum and the maximum of the voltages of the signals output from various oxygen sensors are measured at variety of engine speeds. Table 5 shows the measurement conditions and the results for NOx, and Table 6 shows those for CO. In Tables 5 and 6, A and B are the same as Example 1, and the engine speed for C and D are also the same as Example 1. The air excess rate $\lambda$ and the changeover cycle (Hz) are the same in both Table 5 and Table 6. Samples No. 1 and No. 2 are normal oxygen sensors and Nos. 3 through No. 5 are deteriorating sensors.

TABLE 5

| Emission of NOx in exhaust gas (g/mile) | | | Sensor output voltage (mV) | |
|---|---|---|---|---|
| | | | C | D |
| | Automobile models | | $\lambda = 1.03$ | $\lambda = 1.03$ |
| | | | −0.96 | −0.97 |
| No. | A | B | 2 (Hz) | 1.2 (Hz) |
| 1 | 0.20 | 0.40 | 910–130 | 900–130 |
| 2 | 0.52 | 1.20 | 830–250 | 810–250 |
| 3 | 0.70 | 1.60 | 870–360 | 880–350 |
| 4 | 1.20 | 3.50 | 900–740 | 840–630 |
| 5 | 1.71 | 5.10 | 870–840 | 810–780 |

TABLE 6

| Emission of CO in exhaust gas (g/mile) | | | Sensor output voltage (mV) C λ = 1.03 −0.96 2 (Hz) | D λ = 1.03 −0.97 1.2 (Hz) |
|---|---|---|---|---|
| | Automobile models | | | |
| No. | A | B | | |
| 1 | 5.0 | 2.5 | 910–130 | 900–130 |
| 2 | 7.2 | 4.1 | 780–160 | 810–130 |
| 3 | 9.8 | 6.2 | 520–190 | 580–170 |
| 4 | 11.8 | 8.9 | 400–210 | 440–180 |

As clearly seen in Table 5 and Table 6, in the normal oxygen sensors, No. 1 and No. 2, the difference of the sensor outputs between in the lean air/fuel ratio and in the rich air/fuel ratio is large irrespective of the engine speed. In the deterioration oxygen sensors, No. 3 through No. 5, on the other hand, the difference of the sensor outputs is relatively small. With two predetermined thresholds (e.g., 300 mV and 700 mV), oxygen sensors are thus easily determined to be normal ones or deteriorating ones that increase the exhaust of NOx or CO.

Table 7 shows the preferable measurement conditions.

TABLE 7

| | | Condition 1 | Condition 2 | Condition 3 |
|---|---|---|---|---|
| Engine speed (rpm) | | 500 to 1,000 | 1,000 to 1,500 | 1,500 to 2,000 |
| Frequency (Hz) | | 0.8 to 1.4 | 1.2 to 1.8 | 1.6 to 2.2 |
| λ | rich | ≧0.97 | ≧0.97 | ≧0.96 |
| | lean | ≦1.03 | ≦1.03 | ≦1.04 |

(EXAMPLE 4)

In Example 4, the output signal is measured open loop control but in the feed-back control of the air/fuel ratio. The minimum (in the lean air/fuel ratio) and the maximum (in the rich air/fuel ratio) of the voltages of signals output from various oxygen sensors is measured during the feed-back control of the air/fuel ratio. Table 8 shows the measurement conditions and the results for NOx, and Table 9 shows those for CO. In Tables 8 and 9, C and D denote measurement conditions; that is, automobile model A is driven at a constant speed. Samples No. 1 and No. 2 are normal oxygen sensors and No. 3 and No. 4 are deteriorating sensors.

TABLE 8

| Emission of NOx in exhaust gas (g/mile) | | | Sensor output voltage (mV) C Driving conditions 80 km/hr 8 ps rich-lean | D Driving conditions 40 km/hr 2 ps rich-lean |
|---|---|---|---|---|
| | Automobile models | | | |
| No. | A | B | | |
| 1 | 0.20 | 0.40 | 900–120 | 910–110 |
| 2 | 0.52 | 1.20 | 850–200 | 860–190 |
| 3 | 1.20 | 3.50 | 840–300 | 840–280 |
| 4 | 1.71 | 5.10 | 820–360 | 840–360 |

TABLE 9

| Emission of CO in exhaust gas (g/mile) | | | Sensor output voltage (mV) C Driving conditions 80 km/hr 8 ps rich-lean | D Driving conditions 40 km/hr 2 ps rich-lean |
|---|---|---|---|---|
| | Automobile models | | | |
| No. | A | B | | |
| 1 | 5.0 | 2.5 | 900–130 | 910–110 |
| 2 | 7.2 | 4.1 | 850–200 | 880–160 |
| 3 | 9.8 | 6.2 | 760–350 | 750–280 |
| 4 | 11.8 | 8.9 | 600–400 | 580–350 |

As clearly seen in Table 8 and Table 9, in the normal oxygen sensors, No. 1 and No. 2, the difference of the sensor outputs between the lean air/fuel ratio and the rich air/fuel ratio (i.e., the difference between the maximum and the minimum) is large. In the deteriorating oxygen sensors, No. 3 and No. 4, on the other hand, the difference of the sensor outputs is relatively small. With two predetermined thresholds $V_L$ and $V_H$ (e.g., 250 mV and 850 mV), oxygen sensors are thus easily determined to be normal ones or deteriorating ones, in other words, those increase exhaust of NOx or CO.

Processes of fifth through seventh embodiments for controlling the air/fuel ratio executed by the ECU 3 are now explained based on the corresponding flow charts. Devices of the fifth through seventh embodiments have a substantially identical construction as shown in the schematic view of FIG. 8.

Figure 4:
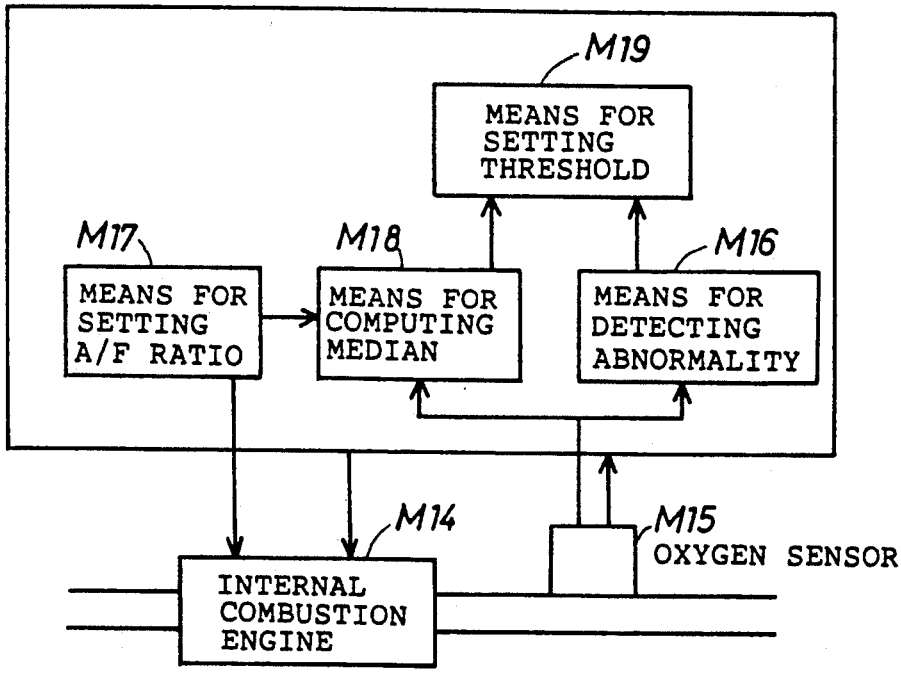
FIG. 4 is a block diagram showing a feature of an air/fuel ratio controlling device according to the invention.
Figure 5:
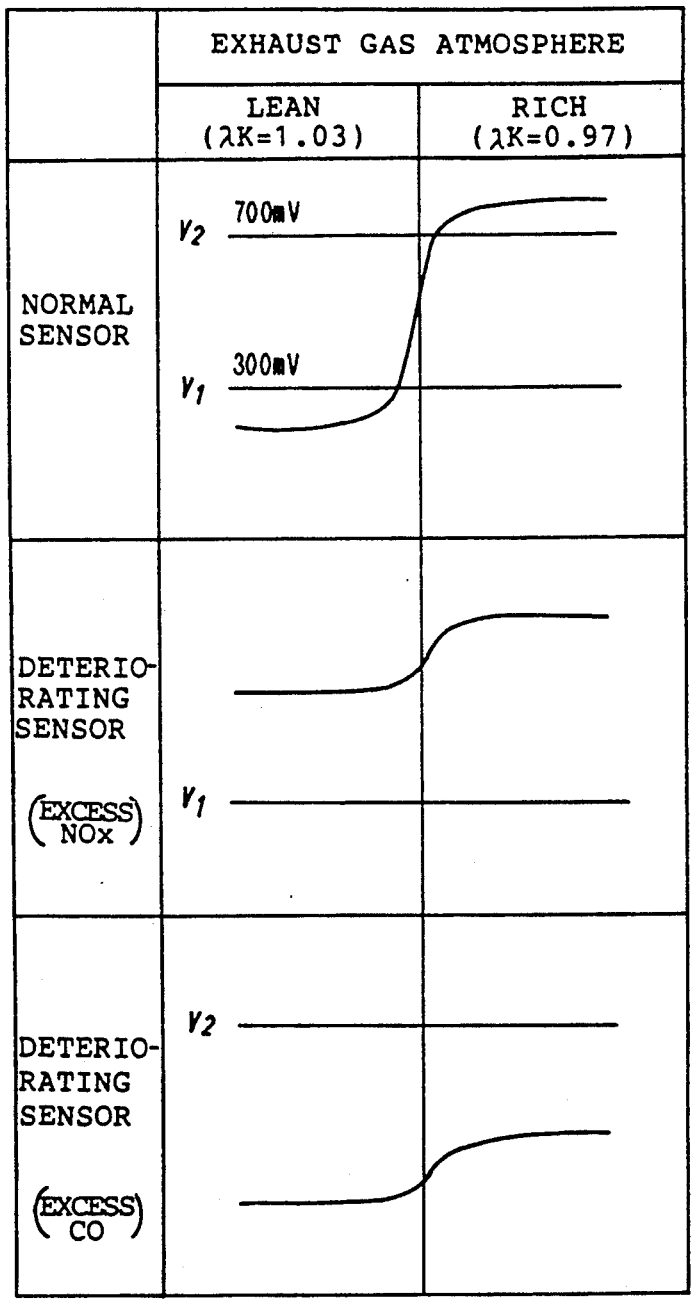
FIG. 5 is an illustrative view showing the principles of the feature of the invention shown in FIG. 1.
Figure 13:
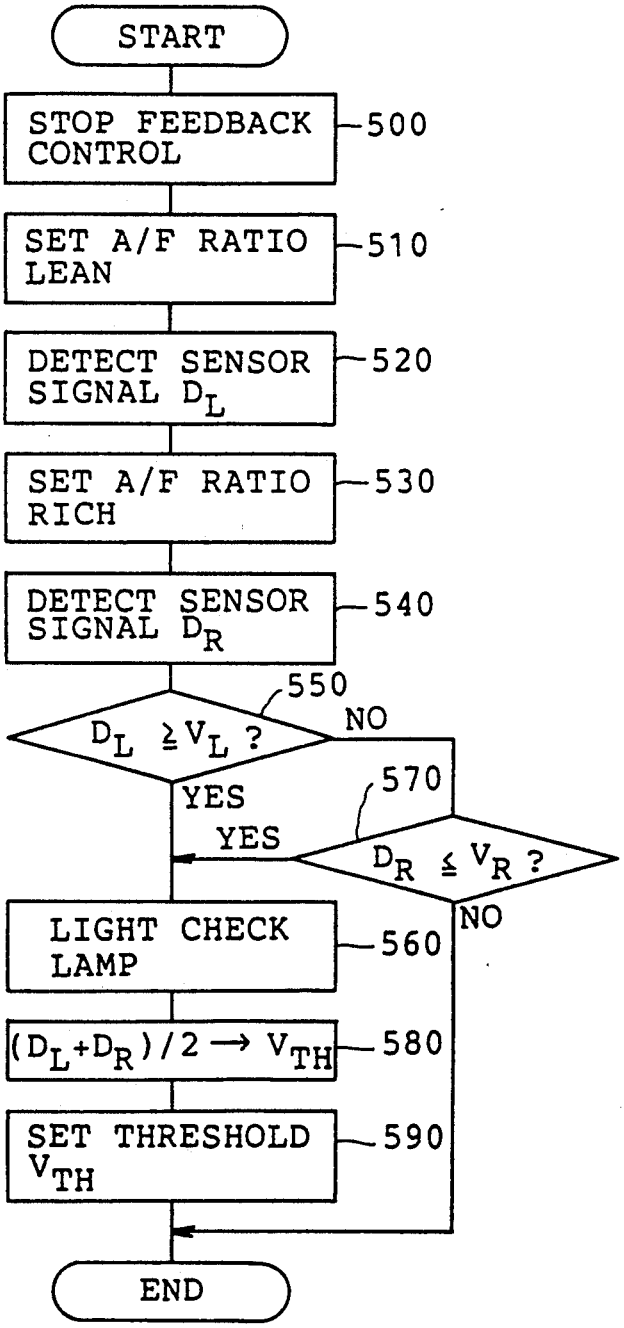
FIG. 13 is a flow chart showing process of a fifth embodiment according to the feature shown in FIG. 4.

The fifth embodiment will be discussed with reference to FIG. 4. Processing for maintaining the air/fuel ratio lean and then rich, measuring the output signal of the oxygen sensor 36 in lean and rich states, and determining the median of the output signal is explained based on the flow chart of FIG. 13. This processing starts after warm-up of the engine 2.

At step 500, the feed-back control of the air/fuel ratio stops and open loop control starts. At step 510, the air/fuel ratio is set to lean (e.g., the air excess rate $\lambda=1.02$) in the open loop control by driving and regulating the fuel ejection valve 25 and is maintained for a certain time period. An output signal $D_L$ of the oxygen sensor 36 for the lean state is detected at step 520.

Then at step 530, the air/fuel ratio is set to rich (e.g., $\lambda=0.98$) in the open loop control by driving and regulating the fuel ejection valve 25 and is maintained for a certain time period. An output signal $D_R$ of the oxygen sensor 36 for the rich state is detected at step 540.

When the output signal $D_L$ of the oxygen sensor 36 in the lean state is not less than a predetermined threshold $V_L$ (e.g., 400 mV), the oxygen sensor is determined to be abnormal at step 550 and the check lamp 40 is then lit at step 560. On the other hand, when the output signal $D_R$ of the oxygen sensor 36 in the rich state is not greater than a predetermined threshold $V_R$ (e.g., 700 mV), the oxygen sensor is determined to be abnormal at step 570 and the check lamp 40 is then lit at step 560.

When the oxygen sensor 36 is determined to be abnormal at either step 550 or step 570, the median $V_{TH}$ of the output signal $D_L$ in lean state and $D_R$ in rich state is determined at step 580. The program proceeds to step 590 at which the median $V_{TH}$ is set as a threshold (slice level) for discriminating lean and rich in the feed-back control of the air/fuel ratio and then exits from the processing.

Figure 14A:
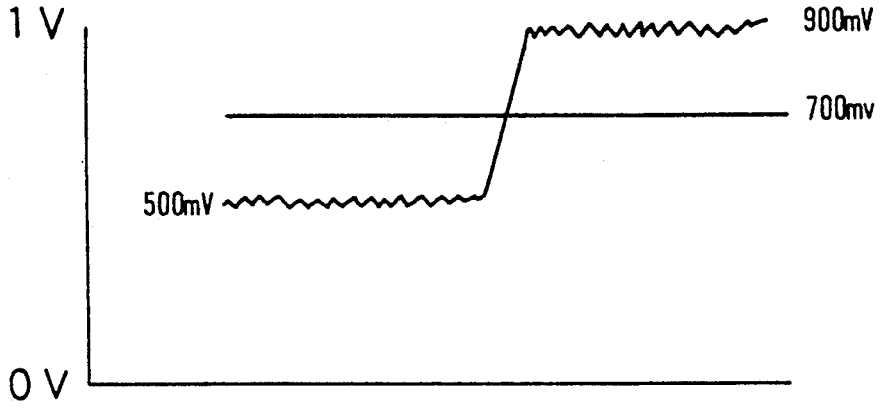
FIGS. 14A and 14B are graphs showing an output signal of the fifth embodiment of FIG. 13.
Figure 14B:
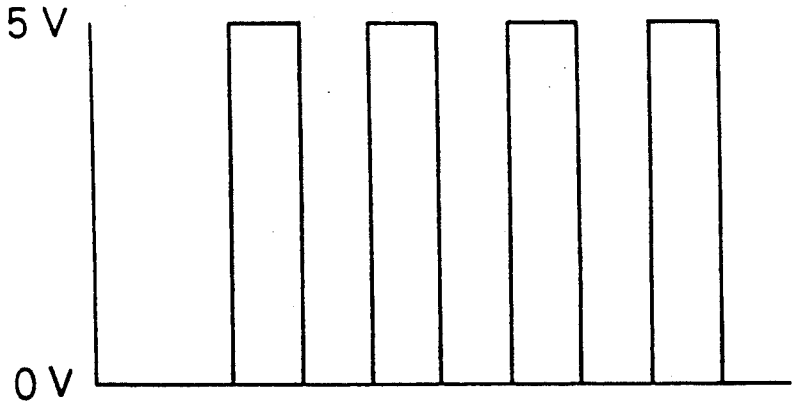

As shown in FIG. 14A, when the voltage of the output signal $D_L$ in $\lambda=1.02$ is 500 mV and that of the output signal $D_R$ in $\lambda=0.98$ is 900 mV, the median $V_{TH}$ is equal to 700 mV. The median $V_{TH}$ is used as the threshold in the feed-back control of the air/fuel ratio. Even if the output signal of the oxygen sensor 36 oscillates at a higher voltage or a lower voltage, virtually the center of the oscillation becomes equal to the threshold. Thus lean and rich states of the air/fuel ratio are appropriately discriminated from each other and are converted into binary signals of 0 V and 5 V as shown in FIG. 14B.

The optimum threshold is set according to the output signal of the oxygen sensor 36 as explained above. Even when the oxygen sensor 36 is contaminated and its output is degraded, the lean and rich states are properly detected and the air/fuel ratio is preferably controlled.

In the fifth embodiment, abnormality of the oxygen sensor 36 is detected in a similar manner as the first or the second embodiment. Other methods, however, may be applied for detecting abnormality of the oxygen sensor. For example, those of the third and fourth embodiments are applicable.

Figure 15:
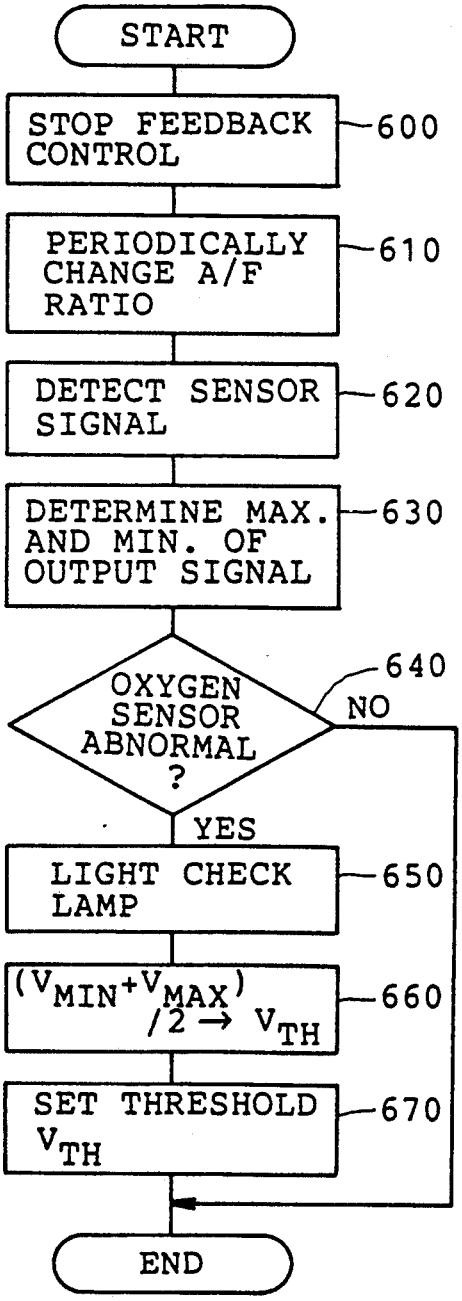
FIG. 15 is a flow chart showing process of a sixth embodiment according to the feature shown in FIG. 4.

The sixth embodiment will also be described with reference to FIG. 4. Processing for controlling the air/fuel ratio by using the minimum and maximum of the output signal of the oxygen sensor 36 are explained based on the flow chart of FIG. 15.

At step 600, the feed-back control of the air/fuel ratio stops and open loop control starts. At step 610, the air/fuel ratio is periodically changed between rich and lean in the open loop control by driving and regulating the fuel injection valve 25. The output signal of the oxygen sensor 36 in rich and lean states is detected at step 620. The minimum $V_{MIN}$ and maximum $V_{MAX}$ of the output signal are then determined at step 630. When even one of the minimum or maximum of the output signal is within a predetermined output range, the oxygen sensor 36 is determined to be abnormal at step 640 and the check lamp 40 is then lit at step 650.

When the oxygen sensor 36 is determined to be abnormal at step 640, the median $V_{TH}$ between the minimum $V_{MIN}$ and the maximum $V_{MAX}$ are determined at step 660. The program proceeds to step 670 at which the median $V_{TH}$ is set as a threshold for discriminating lean and rich in the feed-back control of the air/fuel ratio and then exits from the processing.

Figure 16A:
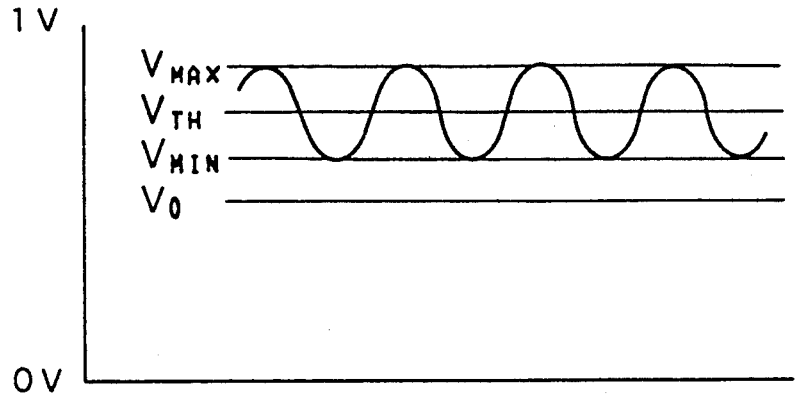
FIGS. 16A and 16B are graphs showing an output signal of the sixth embodiment of FIG. 15.
Figure 16B:
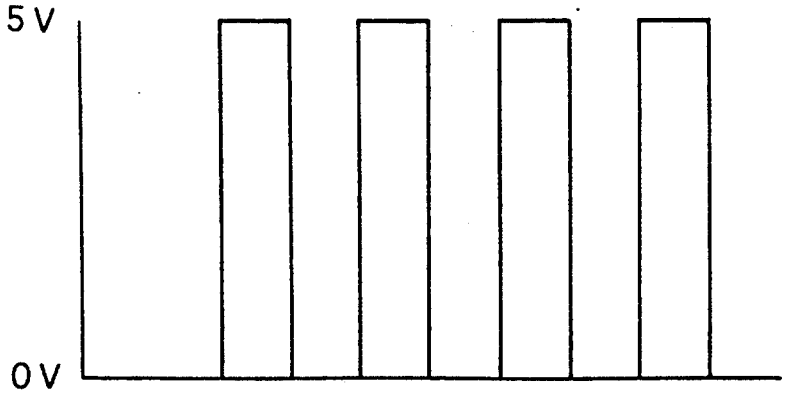

As shown in FIG. 16A, when output signal of the oxygen sensor 36 oscillates at a voltage higher than a predetermined threshold $V_0$, the oxygen sensor 36 is determined to be abnormal, and the median $V_{TH}$ between the minimum $V_{MIN}$ and the maximum $V_{MAX}$ is determined to be a threshold. Even if the output signal of the oxygen sensor 36 is abnormal, lean and rich states of the air/fuel ratio in the feed-back control of the air/fuel ratio are appropriately discriminated from each other and are converted into binary signals of 0 V and 5 V as shown in FIG. 16B.

The optimum threshold is set according to the output signal of the oxygen sensor 36 as explained above. Thus, even when the oxygen sensor 36 is contaminated and its output shifts to a higher or lower voltage, the air/fuel ratio is preferably controlled.

Figure 17:
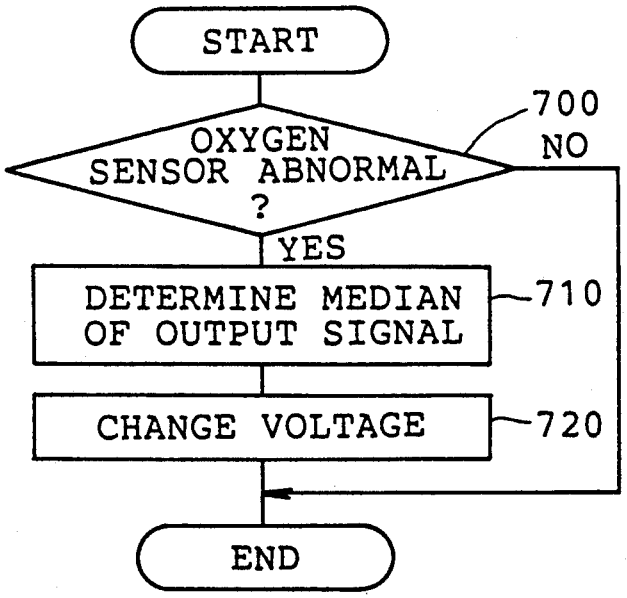
FIG. 17 is a flow chart showing process of a seventh embodiment according to the feature shown in FIG. 4.

The seventh embodiment will also be explained with reference to FIG. 4. An alternative processing for control using the median $V_{TH}$ of the output signal of the oxygen sensor 36 based on the flow chart of FIG. 17.

When abnormality of the oxygen sensor 36 is detected at step 700 in the same manner as the fifth or the sixth embodiments explained above, the median $V_{TH}$ is determined at step 710. The program proceeds to step 720 at which the voltages of the signals output from the oxygen sensor 36 in the feed-back control of the air/fuel ratio are proportionally converted based on the value of the median $V_{TH}$, thus allowing the output signal to be converted into a normal signal with a large variation in amplitude, and the program then exits from the processing.

Figure 18:
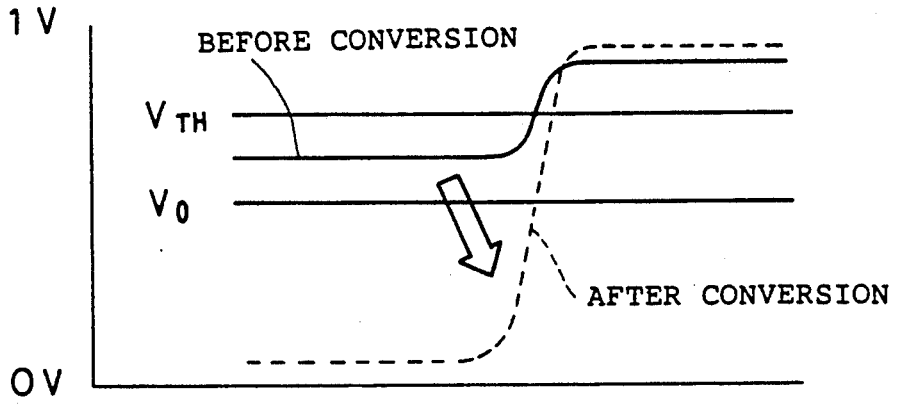
FIG. 18 is a graph showing an output signal of the seventh embodiment.
Figure 19:
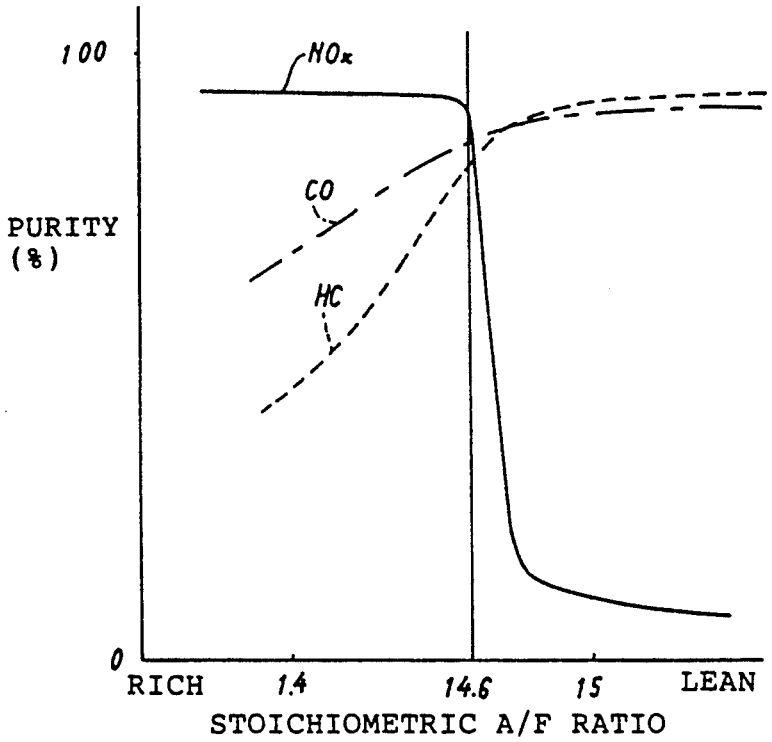
FIG. 19 is a graph showing the relationship between the air/fuel ratio and emission.
Figure 20:
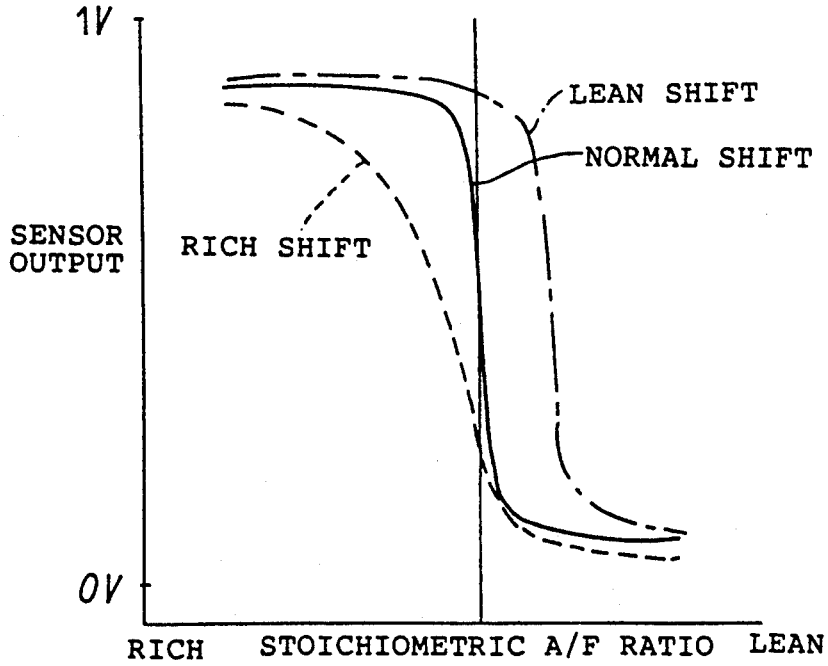
FIG. 20 is a graph showing the relationship between the air/fuel ratio and sensor output.

The voltage generated as an output signal of the oxygen sensor is converted as shown in FIG. 18 and Table 10.

TABLE 10

| Voltage measured (mV) | Voltage converted (mV) |
|---|---|
| 500 | 0 |
| 900 | 1,000 |
| 700 | 500 |
| 600 | 250 |
| 800 | 750 |

For example, when the voltage of the output signal is higher than a predetermined threshold $V_0$, a signal of 500 mV in the lean air/fuel ratio ($\lambda=1.02$) is converted into that of 0 V, and a signal of 900 mV in the rich air/fuel ratio ($\lambda=0.98$) into that of 1 V. The center of the amplitude of the abnormal signal output from the oxygen sensor is corrected to the predetermined threshold $V_0$ or 500 mV; namely, the voltage of an abnormal signal is proportionally converted into that of a normal signal with a large variation in. In this embodiment, when X denotes voltage measured and Y denotes voltage converted, the conversion is performed based on the following equation for conversion.

$$Y=2.5X-1250$$

Since an output signal is compensated in the above manner, even when the signal is shifted to a higher voltage or a lower voltage or have only a small amplitude, the air/fuel ratio is adequately detected using the predetermined threshold $V_0$ and thus is preferably controlled.

As described above, in the apparatus for controlling the air/fuel ratio of the invention, the air/fuel ratio is set lean or rich by open loop control, and the median of an output signal of the oxygen sensor in the lean or rich state is determined. When the oxygen sensor is determined to be abnormal, the median is set as a threshold for discriminating between rich and lean of the air/fuel ratio in the feed-back control. Thus, even when the oxygen sensor deteriorates by contamination and outputs an abnormal signal, the feed-back control of the air/fuel ratio is preferably performed.

What is claimed is:

1. An apparatus for regulating the emission of exhaust gas discharged from an internal combustion engine, comprising:

oxygen sensing means for generating an oxygen concentration signal indicating the concentration of exhaust gas discharged from an internal combustion engine;

air/fuel ratio setting means for setting the air/fuel ratio of air to fuel in an air/fuel mixture supplied to the internal combustion engine based on a predetermined threshold value and the value of the oxygen concentration signal during closed loop control and for selectively setting the air/fuel ratio to either rich or lean during open loop control; and abnormality detection means operable during open loop and closed loop control for determining that the oxygen sensing means is abnormal when the oxygen concentration signal is outside of a predetermined range.

2. The apparatus of claim 1, in which the abnormality detection means determines that the oxygen sensing means is abnormal when the value of the oxygen concentration signal is not less than a predetermined value while the air/fuel ratio setting means sets the air/fuel ratio to lean during open loop control.

3. The apparatus of claim 1, in which the abnormality detection means determines that the oxygen sensing means is abnormal when the value of the oxygen concentration signal is not greater than a predetermined value while the air/fuel ratio setting means sets the air/fuel ratio to rich during open loop control.

4. The apparatus of claim 1, in which the predetermined range is defined by a first predetermined value and a second predetermined value, where the second predetermined value is greater than the first predetermined value.

5. The apparatus of claim 4, in which the abnormality detection means determines that the oxygen sensing means is abnormal when the oxygen concentration signal is not less than the first predetermined value while the air/fuel ratio setting means sets the air/fuel ratio to lean during open loop control or when the oxygen concentration signal is not greater than the second predetermined value while the air/fuel ratio setting means sets the air/fuel ratio to rich during open loop control.

6. The apparatus of claim 5, in which the abnormality detection means determines that the oxygen sensing means is abnormal while the air/fuel ratio setting means periodically changes the air/fuel ratio between lean and rich during open loop control.

7. The apparatus of claim 4, in which the abnormality detection means determines that the oxygen sensing means is abnormal when the oxygen concentration signal is not less than the first predetermined value while the air/fuel ratio setting means sets the air/fuel ratio to lean and the oxygen concentration signal is not greater than the second predetermined value while the air/fuel ratio setting means sets the air/fuel ratio to rich.

8. The apparatus of claim 7, in which the abnormality detection means determines that the oxygen sensing means is abnormal while the air/fuel ratio setting means changes the air/fuel ratio between lean and rich during feedback control.

9. The apparatus of claim 5 further comprising:

median calculation means for calculating a median of the minimum and maximum of the oxygen concentration signal; wherein when the abnormality detection means determines that the oxygen sensing means is abnormal, the abnormality detection means calculates a new threshold value, and the air/fuel ratio setting means sets the air/fuel ratio based on the new threshold value and the value of the oxygen concentration signal.

10. The apparatus of claim 9, in which the abnormality detection means determines that the oxygen sensing means is abnormal during open loop control by measuring the minimum of the oxygen concentration signal while the air/fuel ratio setting means sets the air/fuel ratio to lean and then measuring maximum of the oxygen concentration signal while the air/fuel ratio setting means sets the air/fuel ratio to rich.

11. The apparatus of claim 7, in which the abnormality detection means determines that the oxygen sensing means is abnormal during open loop control by measuring the maximum and minimum of the oxygen concentration signal while the air/fuel ratio setting means periodically changes the air/fuel ratio between lean and rich.

12. The apparatus of claim 5, further comprising:

median calculation means for calculating a median of the minimum and maximum of the oxygen concentration signal; wherein when the abnormality detection means determines that the oxygen sensing means is abnormal, the abnormality detection means determines a conversion factor based on the median of the minimum and maximum of the output signal and calculates a converted oxygen concentration signal from the conversion factor, and the air/fuel ratio setting means sets the air/fuel ratio based on the threshold value and the converted oxygen concentration signal.

13. The apparatus of claim 1, further comprising:

median calculation means for calculating the median of the maximum and minimum of the oxygen concentration signal when the air/fuel ratio setting means changes the air/fuel ratio between rich and lean; wherein the abnormality detection means alters the threshold value based on the median of the oxygen concentration signal when the abnormality detection means determines that the oxygen sensing means is abnormal.

14. The apparatus of claim 1, further comprising:

median calculation means for calculating the median of the maximum and minimum of the oxygen concentration signal when the air/fuel ratio setting means changes the air/fuel ratio between rich and lean; wherein the abnormality detection means alters oxygen concentration signal based on the median of the oxygen concentration signal when the abnormality detection means determines that the oxygen sensing means is abnormal.

15. An apparatus for detecting abnormality of an oxygen sensor that generates an oxygen concentration signal corresponding to the concentration of oxygen discharged from an internal combustion engine, comprising:

air/fuel ratio setting means for changing the air/fuel ratio of an air/fuel mixture supplied to the internal combustion engine between lean and rich;

limit value detecting means for detecting the minimum and maximum of the oxygen concentration signal when the air/fuel ratio setting means changes the air/fuel ratio between lean and rich; and abnormality detection means for determining that the oxygen sensor is abnormal when at least one of the minimum and maximum values detected by the limit value detecting means is within a predetermined range.

16. The apparatus of claim 15, in which the air/fuel ratio setting means periodically changes the air/fuel ratio of the air/fuel mixture under open loop control.

17. The apparatus of claim 15, in which the air/fuel ratio setting means changes the air/fuel ratio of the air/fuel mixture under closed loop control.

18. The apparatus of claim 15, in which the minimum and maximum values are determined by averaging plural measurements.

* * * * *